United States Patent [19]

Lauwerijssen et al.

[11] 4,142,125

[45] Feb. 27, 1979

[54] FLUORESCENT DISCHARGE LAMP WITH INNER HOLLOW TUBE OFFSET FROM ENVELOPE AXIS

[75] Inventors: Petrus C. Lauwerijssen; Antonius J. Van Meer, both of Eindhoven, Netherlands

[73] Assignee: U.S. Philips Corporation, New York, N.Y.

[21] Appl. No.: 799,719

[22] Filed: May 23, 1977

[30] Foreign Application Priority Data

Jun. 17, 1976 [NL] Netherlands ..... 7606547

[51] Int. Cl.[2] ..... H01J 61/10; H01J 61/30; H01J 61/42

[52] U.S. Cl. ..... 313/485; 313/204; 313/490; 313/493

[58] Field of Search ..... 313/493, 204, 485, 490

[56] References Cited

U.S. PATENT DOCUMENTS

| | | | |
|---|---|---|---|
| 2,281,579 | 5/1942 | Henninger, Jr. et al. | 313/493 X |
| 2,561,868 | 7/1951 | Jenkins et al. | 313/220 X |
| 3,609,436 | 9/1971 | Campbell | 313/493 X |
| 3,898,720 | 8/1975 | Morehead | 313/490 X |

FOREIGN PATENT DOCUMENTS

| | | | |
|---|---|---|---|
| 2529005 | 1/1976 | Fed. Rep. of Germany | 313/485 |

OTHER PUBLICATIONS

"Bright Ideas Creates Bright Light", Article in Automation, Jun., 1976, p. 20.

*Primary Examiner*—Palmer C. Demeo
*Attorney, Agent, or Firm*—David R. Treacy; Robert S. Smith

[57] ABSTRACT

A low-pressure gas discharge lamp having an inner tube in the discharge space limited by a lamp envelope the outer wall of which inner tube is provided with a luminescent coating, the portion which is provided with this luminescent coating facing away from the portion of the inner tube which is nearest to the wall of the lamp envelope.

7 Claims, 3 Drawing Figures

FLUORESCENT DISCHARGE LAMP WITH INNER HOLLOW TUBE OFFSET FROM ENVELOPE AXIS

Figure 1:
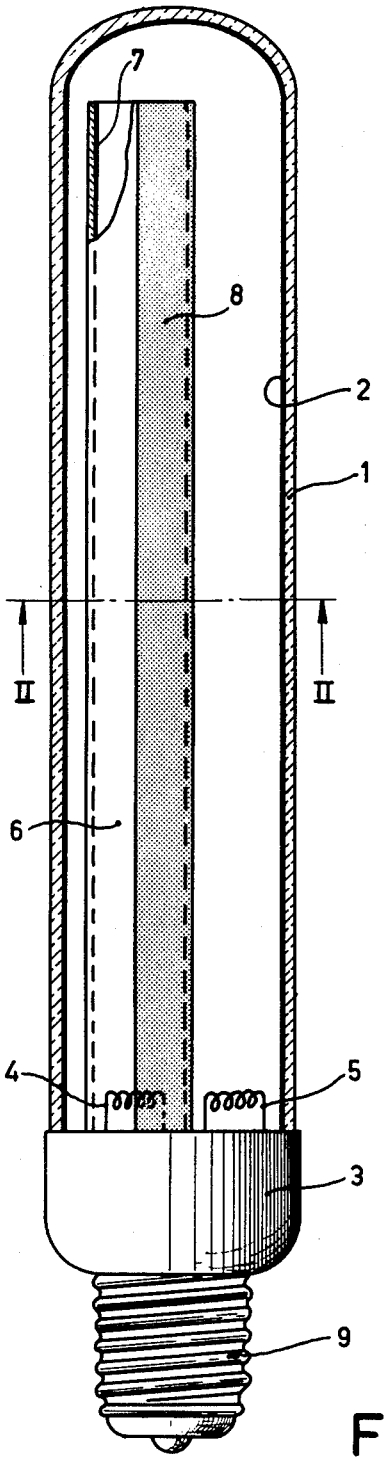

The invention relates to a low-pressure gas discharge lamp having a discharge space which is limited by a lamp envelope and which comprises electrodes, one of which is disposed in an inner tube located within the lamp envelope, the inner wall of the lamp envelope being provided with a luminescent coating.

Such a lamp is disclosed in U.S. Pat. No. 3,609,436.

One of the problems encountered in lamps whose dimensions after folding of the discharge path are reduced by applying an inner tube around an electrode is the lack of a homogeneous light distribution on the outside of the lamp envelope.

With the lamps which are disclosed in the above-mentioned United States Patent Specification this problem is solved by providing a plurality of electrodes on the base of the lamp within the lamp envelope on the outside of an inner tube which is axially, placed around an electrode, the discharge path between the electrodes in the inner tube and the remaining electrodes being displaced so quickly across said last electrodes that for the eye a homogeneous distribution of light is obtained, that is to say the lamp has on the outside a brightness which is substantially of the same value across the entire surface. The drawback of such a lamp is, however, that a great number of electrodes is necessary which detrimentally influences the dimensions in the transverse direction. In addition, a complicated electric circuit is required for electronically controlling the various electrodes.

It is an object of the invention to provide a small-size lamp having a high luminous efficacy per unit of volume, which has a brightness on the outside of the lamp which is substantially of the same value across the entire surface and which has, in addition, a high luminescent efficacy per unit of power supplied.

According to the invention a low-pressure gas discharge lamp of the type described is characterized in that the inner tube is placed excentrically in the lamp envelope and its outer wall is coated over not more than 80% of the circumference over substantially the entire length with a luminescent coating, the portion of the inner tube which is provided with the luminescent coating facing away from the portion of the inner tube which is nearest to the lamp envelope wall.

By applying a coating of luminescent material to the outer wall of the inner tube in accordance with the invention a lamp is obtained having a brightness at the outside of the lamp which is substantially of the same value over the entire surface, so with a homogeneous light distribution. In a lamp according to the invention the outer surface of the portion of the inner tube located nearest to the wall of the lamp envelope is free from a luminescent coating. Should the outer wall of the inner tube be fully coated with a luminescent coating the luminescent efficacy per unit of power supplied, the efficiency, would be affected in a negative sense because in the lamp there is a luminescent coating which has no function for the conversion of the useful radiation, generated by the discharge into visible and which introduces losses of visible light by absorption. Namely, the useful radiation generated by the gas discharge and which is converted into visible light by the luminescent layer is effected, besides within the inner tube, in that portion of the space between the inner tube and the lamp envelope where the spacing between the outer wall of the inner tube and the wall of the lamp envelope is as great as possible.

An advantage of a lamp according to the invention is that the discharge path need not jump between several electrodes to enable a homogeneous light distribution; this makes the use of complicated circuits for the electronic control of the electrodes superfluous. As in principle only two electrodes are necessary for the proper functioning of the lamp, the cross-sectional dimension of the lamp can be made as small as possible.

The material the inner tube consists of may be transmissive or not transmissive for the useful radiation generated in the discharge space, such as ultraviolet radiation which is generated in low-pressure mercury vapour discharge lamps. If, for example, the lime glass which is not transmissive to ultraviolet radiation but transmissive for visible light is used the entire inner wall of the inner tube is coated with a luminescent coating. If, on the contrary the material is resistant to such radiation and also transmissive to it such as, for example, quartz glass then the inner wall need not of necessity be provided with a luminescent coating.

In a preferred embodiment of a lamp according to the invention the outer wall of the inner tube is coated over half the circumference over the entire length of the tube with a luminescent coating.

In another embodiment of a lamp according to the invention the quotient of the internal diameter of the inner tube and the internal diameter of the lamp envelope is between 0.4 and 0.6. If the diameter of the inner tube is too large relative to the diameter of the lamp envelope the discharge is constricted to a narrow strip in the widest portion between the inner tube and the lamp envelope. The result thereof is that a bright stripe becomes visisble at the outside of the lamp which is detrimental to a homogeneous light distribution. If on the contrary the diameter of the inner tube is too small then, owing to the compressed discharge in the inner tube the efficiency of the lamp will decrease and, furthermore it is difficult to obtain an even light distribution.

The luminous efficacy of a lamp according to the invention can be increased by providing the discharge space wholly or partly with a thinly distributed solid state body having a structure which is permeable to the discharge, for example glass wool.

With the small dimensions of the lamp the temperature of the discharge space can reach such a value that the vapour pressure which is the critical pressure for the optimum conversion of electrical energy into useful radiation is exceeded. In these cases the conversion efficiency can again be increased by using means which are known per se, for example cooling of the lamp, such as providing the electrode assemblies with radiation shields; another means to obtain this object is providing an alloy in the discharge space which controls the vapour pressure. An example of such an alloy in a low-pressure mercury vapour discharge lamp is an amalgam of indium and mercury. The metal or the alloy which can form an amalgam with mercury may, for example, be applied in the form of dots on a metal plate which is secured by means of a supporting wire to the top of the inner tube in a relatively cool spot in the lamp.

The invention can be used for low-pressure gas discharge lamps wherein the useful radiation generated in the discharge space is converted into visible light by a luminescent layer. Preferably the invention is used for low-pressure mercury vapour discharge lamps.

The invention will now be further explained with reference to a drawing.

Figure 2:
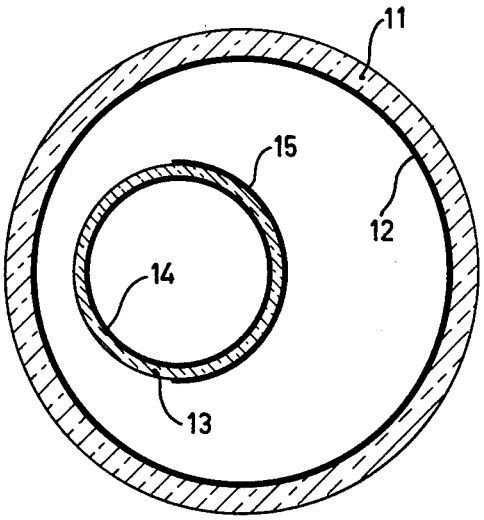

In the drawing FIG. 1 shows partly in a perspective view a low-pressure mercury vapour discharge lamp according to the invention and FIG. 2 shows a cross-sectional view of a low-pressure mercury vapour discharge lamp according to the invention.

Figure 3:
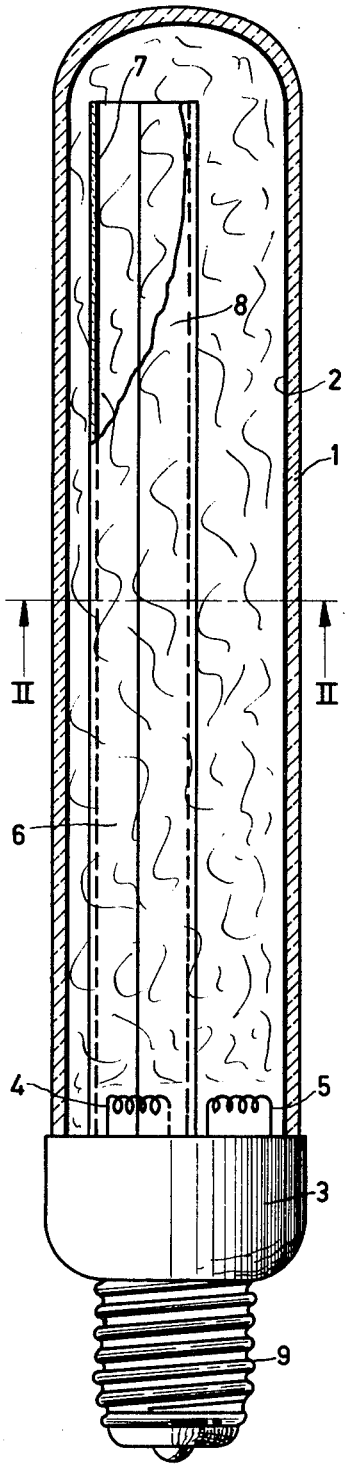

FIG. 3 is an elevational drawing of another embodiment of the invention which has glass wool disposed in said outer envelope.

The lamp shown in FIG. 1 has a discharge space limited by the lamp envelope 1 whose inner wall is provided with a luminescent coating 2 which consists, for example, of calcium halophosphate activated by manganese and antimony. The lamp is filled with mercury vapour and a rare gas or a combination of rare gases. Two thermally emitting electrodes 4 and 5 are disposed side by side on the base 3 of the lamp envelope. Around electrode 4 a limeglass tube 6 has been applied whose entire inner wall is coated with a luminescent coating 7 which also consists of calcium halophosphate activated by manganese and antimony. The outer wall of this tube is also provided over half its circumference over the entire length with a luminescent coating 8. The length of the envelope of this lamp is approximately 20 cm the length of the inner tube is 18 cm so that the total length of the discharge path is approximately 36 cm. The internal diameter of the lamp envelope is 3.6 cm. The internal diameter of the inner tube 6 is 1.8 cm. With an applied power of 20 W and a pressure of 2.5 Torr of a mixture of 75% argon and 25% neon the total luminous efficacy was 950 lumens. The end of the lamp is provided with a cap with screwthread 9, a glow discharge starter with capacitor being fitted in the cap.

FIG. 2 shows a cross-section over the line II—II of a lamp as described in FIG. 1. The glass wall of the discharge space indicated by 11 is provided with a coating of luminescent material 12. The inner tube is indicated by 13. This tube is coated on the inside with luminescent material 14. At the outside of the inner tube there is over only half of the circumference a luminescent coating 15, on a portion facing away from the portion of the inner tube which is nearest to the wall of the lamp envelope. If more than 80% of the outside of the inner tube is coated with a luminescent layer an uneven light distribution of the lamp is obtained.

The embodiment of FIG. 3 includes glass wool disposed in the discharge space. In all other respects the lamp has those characteristics which are shown in the embodiment of FIG. 1.

What is claimed is:

1. A low pressure gas discharge lamp which comprises an elongated sealed, light transparent lamp envelope having first and second ends and a geometric axis, an ionizable medium in said lamp envelope, a first electrode in said lamp envelope at said one end thereof, a discharge space within said lamp envelope, an elongated hollow inner tube disposed within said lamp envelope with one end thereof disposed about said first electrode and engaging said first end of said lamp envelope, the other end of said inner tube being open to the interior of said lamp envelope, a second electrode disposed in said inner tube at said first end thereof, and a luminescent coating disposed on at least a portion of the inner wall of said lamp envelope, said inner tube having a geometric axis, said inner tube being disposed in said lamp envelope with said axis of said envelope and said axis of said tube being generally parallel, said tube being eccentrically disposed in said lamp envelope and further including a luminescent coating on the outer wall of said inner tube extending over not more than 80% of the circumferential extent of said inner tube, the portion of said inner tube which is provided with a luminescent coating facing away from the portion of said inner tube which is nearest to the wall of the lamp envelope, said lamp having not more than one inner tube in said lamp envelope.

2. A low-pressure gas discharge lamp as claimed in claim 1 wherein the luminescent coating disposed on the outer wall of said inner tube extends over the entire axial extent thereof.

3. A low-pressure gas discharge lamp as claimed in claim 1 wherein the quotient of the diameter of said inner tube and the diameter of said lamp envelope is between 0.4 and 0.6.

4. A low-pressure gas discharge lamp as claimed in claim 1 further including a thinly distributed solid state body having a structure which is permeable to the discharge disposed in said discharge space.

5. A low-pressure gas discharge lamp as claimed in claim 1 further including means for limiting the vapour pressure within said discharge space.

6. A low-pressure gas discharge lamp as claimed in claim 5 wherein said means for limiting includes an alloy disposed within said lamp envelope.

7. A low-pressure gas discharge lamp as claimed in claim 1 wherein said luminescent coating on said inner tube extends over approximately half of the circumferential extent of said inner tube.

* * * * *